US007481673B1

(12) United States Patent
Qu et al.

(10) Patent No.: US 7,481,673 B1
(45) Date of Patent: Jan. 27, 2009

(54) AIRTIGHT RF COAXIAL CONNECTOR WITH SELF-LOCKING BY SNAP-FASTENING

(76) Inventors: Jinliang Qu, Room 302, Gudai Road 1266-48, Shanghai 201102 (CN); Weiquan Zhou, 2nd Floor, No. 160 DingMaoQiao Road, Zhenjiang City, Jiangsu 212009 (CN)

( * ) Notice: Subject to any disclaimer, the term of this patent is extended or adjusted under 35 U.S.C. 154(b) by 0 days.

(21) Appl. No.: 12/149,707

(22) Filed: May 7, 2008

(51) Int. Cl.
*H01R 9/05* (2006.01)

(52) U.S. Cl. ..... 439/578

(58) Field of Classification Search ..... 439/345, 439/354, 357, 578, 675
See application file for complete search history.

(56) References Cited

U.S. PATENT DOCUMENTS 6,692,286 B1 * 2/2004 De Cet ..... 439/352
7,238,047 B2 * 7/2007 Saettele et al. ..... 439/578

OTHER PUBLICATIONS

"SnapN Connectors: Compatible with N Connectors," Rosenberger News, Jul. 31, 2006, http://www.rosenberger.de/en/News/2004_10_SnapN_new.php.

"News product series SnapN," Mar. 15, 2007, http://www.imscs.com/product-news.html?&no_cache=1&tx_ttnews[tt_news]=6&tx_ttnews[backPid]=9&cHash=16110dfd5a.

* cited by examiner

*Primary Examiner*—Khiem Nguyen
(74) *Attorney, Agent, or Firm*—McDermott Will & Emery LLP

(57) ABSTRACT

An airtight RF coaxial connector with self-locking by snap-fastening is disclosed. The front end of the plug outer conductor is in the shape of continuous circles, forming an overall ring; the front end of the plug outer conductor is provided with a ring-shaped bulge with right angle trapezoid shaped cross section, the hypotenuse of the trapezoid being faced with the front side of the socket connector, and the right angle side of the trapezoid being positioned normal to the longitudinal axis of the socket connector on the back side of the connector; the inner part of the socket connector is provided with a groove provided with a sealing ring; and the distance between the mid-point of the ring bulge and the front contact surface of the plug outer conductor corresponds to that between the mid-point of the groove and the front contact surface of the socket connector. The abolishment of the four-way slits at the front end of the plug outer conductor not only increases the stiffness of the outer conductor, but also decreases the leakage of RF. When the connector is in connection, the conical surface of the plug outer conductor will automatically extrude the sealing ring on the inner side of the socket outer conductor so as to realize ideal sealing effects.

6 Claims, 3 Drawing Sheets

AIRTIGHT RF COAXIAL CONNECTOR WITH SELF-LOCKING BY SNAP-FASTENING

FIELD OF THE INVENTION

The present invention relates to an airtight RF coaxial connector with self-locking by snap-fastening, in particular, to a modified plug of airtight RF coaxial connector with self-locking by snap-fastening.

PRIOR ART

ROSENBERGER Company and IMS Connector Systems Company publish a technical solution of QUICK LOCK N called SnapN on their websites on Jul. 31, 2006 and Mar. 15, 2007, respectively. The solution realizes zero clearance between contact surfaces, which perfectly met up with the designing standard of RF connectors and improves their efficiency greatly.

However, the above solution involves no sealing function. Besides, the contact pressure of the plug outer conductor comes from the spring inside the plug. It can result in momentary separation between the end surfaces of the outer conductor, and in instability in performance (especially PIM). In order to increase the contact pressure of the outer conductor, we must increase the acting force of the spring must be increased. But if the acting force of the spring is increased, the extrusion force required for plugging must be also increased. Moreover, the contact head of the plug outer conductor has four longitudinal slits exposed out of the connector, involving no protection. In such cases, the plug outer conductor can be easily collided in practical application, resulting in its deformation and performance deterioration.

SUMMARY OF THE INVENTION

The object of the present invention is to provide an airtight RF coaxial connector with self-locking by snap-fastening, which can prevent harmful substances, such as dust, mould, oxygen, sulfur dioxide, and water, from entering the connector and oxidizing or corroding the contact parts, so as to greatly improve the reliability of the connector.

Another object of the present invention is to provide an airtight RF coaxial connector with self-locking by snap-fastening, which can increase the stiffness of the plug outer conductor and the extrusion force of the contact head.

Another object of the present invention is to provide an airtight RF coaxial connector with self-locking by snap-fastening, which can protect the contact head of the plug outer conductor and prevent it from collision and deformation in practical application so as to ensure the performance of the connector.

Therefore, the present invention provides an airtight RF coaxial connector with self-locking by snap-fastening, whose plug connector comprises a plug outer conductor, a locking cup connected with a socket connector, and an inner spring provided between the plug outer conductor and the locking cup, characterized in that the front end of the plug outer conductor is in the shape of continuous circles, forming an overall ring; that the front end of the plug outer conductor is provided with a ring-shaped bulge with right angle trapezoid shaped cross section, the hypotenuse of the trapezoid being faced with the front side of the socket connector, the right angle side of the trapezoid being positioned normal to the longitudinal axis of the socket connector on the back side of the connector; that the inner part of the socket connector is provided with a groove provided with a sealing ring; and that the distance between the mid-point of the ring bulge and the front contact surface of the plug outer conductor corresponds to that between the mid-point of the groove and the front contact surface of the socket connector.

Preferably, the cross section of the groove is in the shape of a trapezoid. The hypotenuse side of the trapezoid is positioned facing the hypotenuse of the longitudinal section of the ring bulge.

Preferably, the cross section of the sealing ring is in the shape of a circle or trapezoid.

Preferable, the distance between the mid-point of the ring bulge and the front contact surface of the plug outer conductor is the same as that between the mid-point of the groove and the front contact surface of the socket connector.

According to the other aspect of the present invention, the invention also provides a plug connector of airtight RF coaxial connector with self-locking by snap-fastening, which comprises a plug outer conductor, a locking cup connected with a socket connector, and an inner spring between the plug outer conductor and the locking cup, characterized in that the front end of the plug outer conductor is in the shape continuous circles, forming an overall ring; that the front end of the plug outer conductor is provided with a ring bulge with longitudinal section in the shape of right angle trapezoid; that the hypotenuse of the trapezoid is faced with the front side of the socket connector, being used to extrude the sealing ring positioned in the groove in the inner hole of the socket connector; that the right angle side of the trapezoid is normal to the longitudinal axis of the socket connector on the back side of the connector; and that the distance between the mid-point of the ring bulge and the front contact surface of the plug outer conductor corresponds to that between the mid-point of the groove and the front contact surface of the socket connector.

The airtight RF coaxial connector with self-locking by snap-fastening of the present invention abolishes the four-way slits at the front end of the plug outer conductor, not only strengthening the stiffness of the outer conductor, but also decreasing the leakage of RF.

In particular, an airtight structure has been designed according to the airtight. RF coaxial connector with self-locking by snap-fastening of the present invention. A ring bulge is added to the outer circular surface of the plug outer conductor, and a groove is also provided at the inner side of the socket for a sealing ring. When the connector is under connection, the conical surface of the plug outer conductor will automatically extrude the sealing ring inside the socket outer conductor so as to realize ideal sealing effect.

DETAILED DESCRIPTION OF THE PRESENT INVENTION

Figure 1:
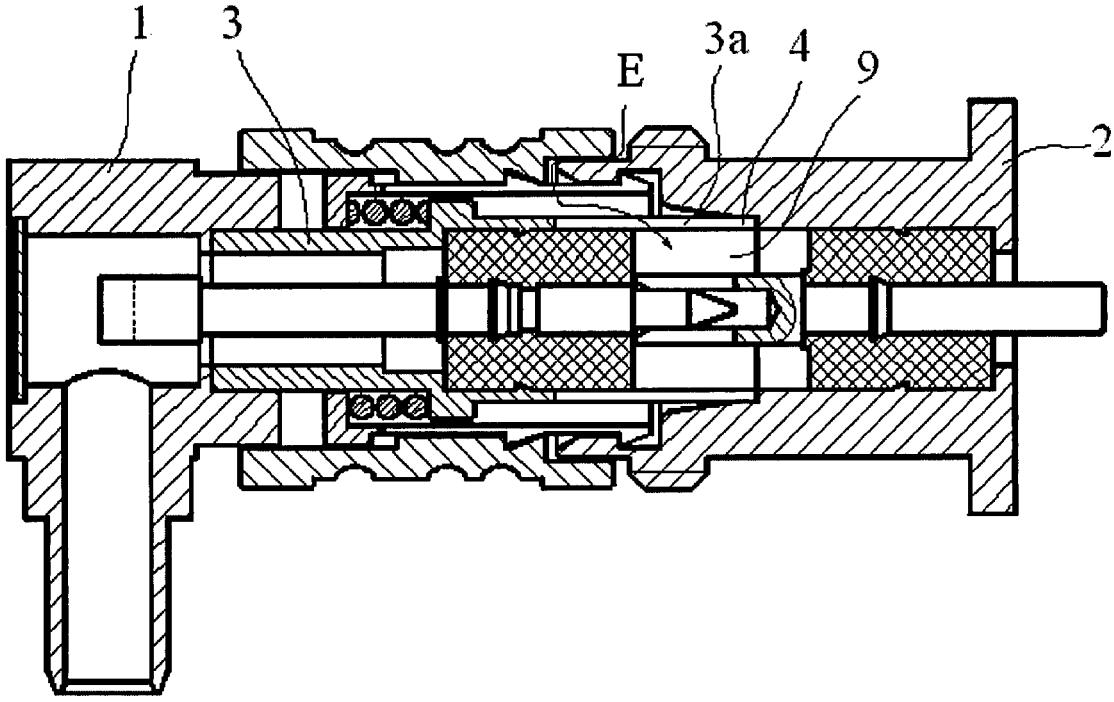
FIG. 1 shows a schematic view of the structure of the electrical connector whose plug is connected with the socket according to the prior art.
Figure 2:
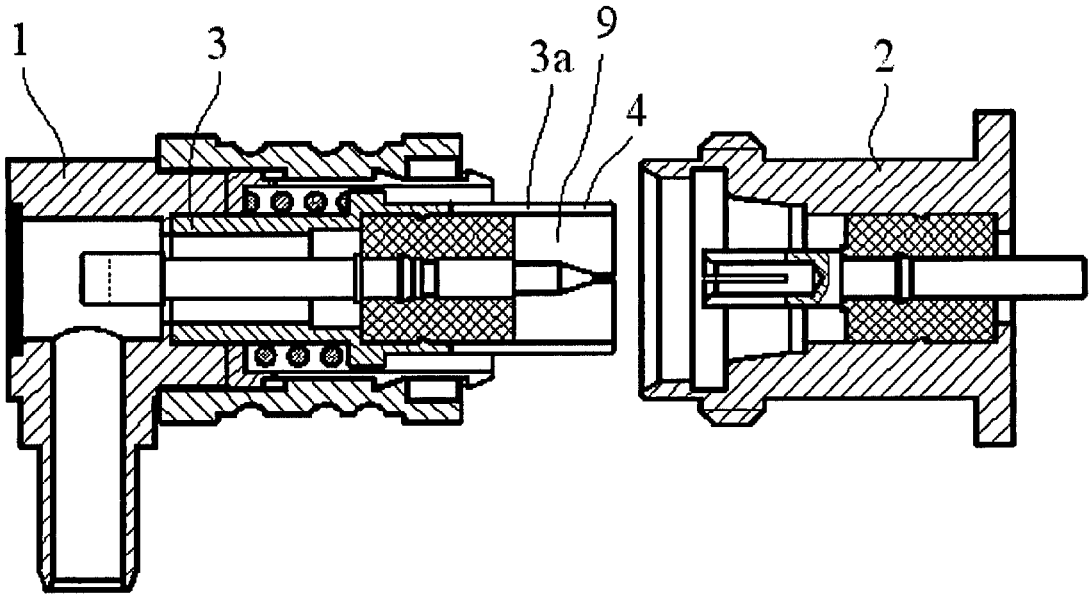
FIG. 2 shows a schematic view of the structure of the electrical connector whose plug is disconnected with the socket according to the prior art.
Figure 3:
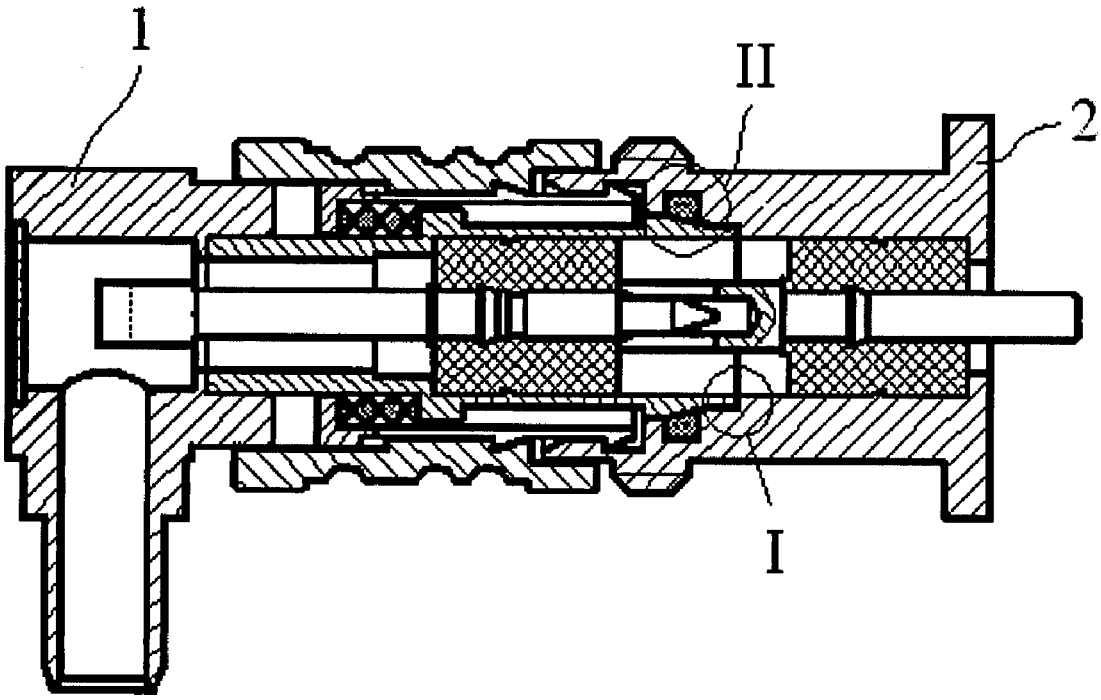
FIG. 3 shows a schematic view of the structure of the electrical connector whose plug is connected with the socket according to the present invention.
Figure 3A:
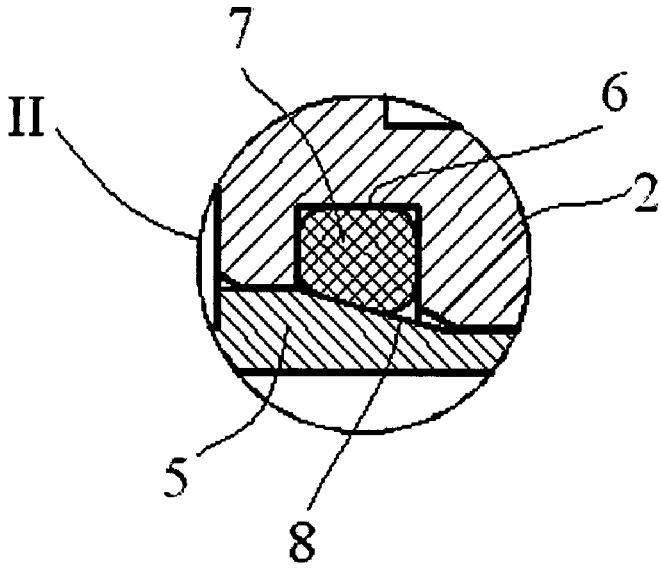
FIG. 3*a* shows a partially enlarged view of part II in FIG. 3.
Figure 3B:
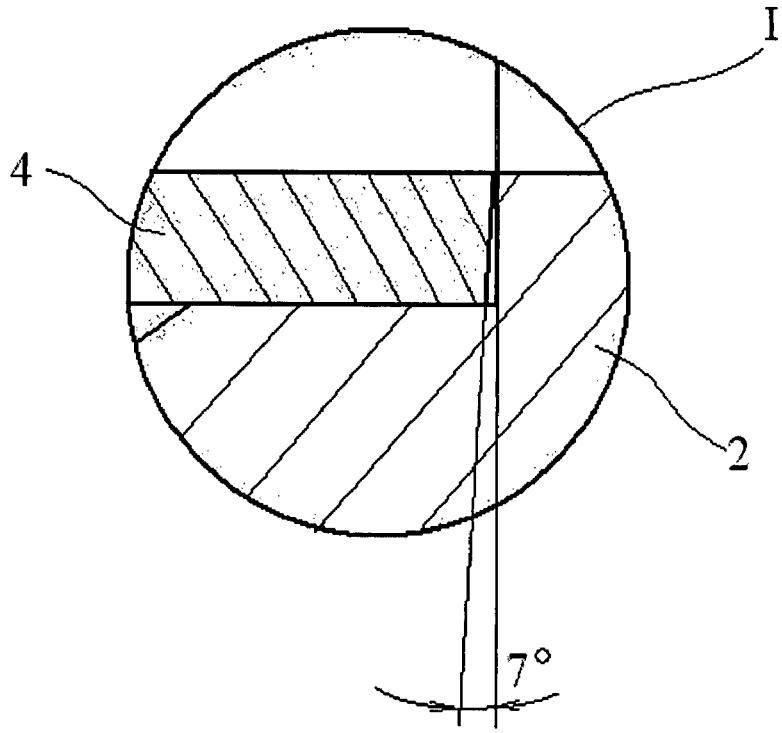
FIG. 3*b* shows a partially enlarged view of part I in FIG. 3.
Figure 4:
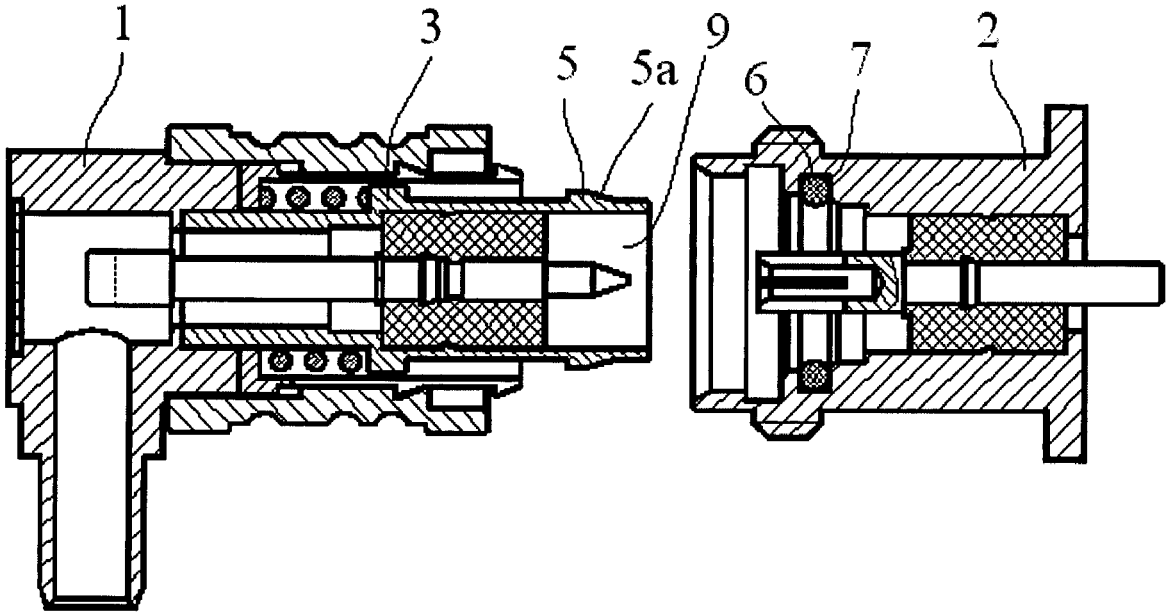
FIG. 4 shows a schematic view of the structure of the electrical connector whose plug is disconnected with the socket according to the present invention.

As shown in FIGS. 1 and 2, the coaxial RF connector in accordance with prior art comprises a plug connector 1 and a socket connector 2. The front end 4 of the plug outer conductor 3 (cylinder-shaped) of the plug connector 1 is provided with four longitudinal slits 3*a* evenly distributed along the plug outer conductor. But the connector has no sealing means.

Such longitudinal slits 3*a* can result in at least the following problems that the longitudinal slits 3*a* can cause discontinuous impedance and signal reflex; that the longitudinal slits 3*a* opening to air can be easily collided and damaged to deformation, resulting in the connector's poor performance in connection; and that the longitudinal slits 3*a* can allow dust, mould, and gases like $O_2$, $SO_2$, $H_2O$ to enter the inner part 9 of the connector along the path as shown by Arrow E. In such cases, the contact parts will be oxygenized and corroded, resulting in unreliable connection between the plug and the socket and poor electrical property. The connector can break down under extremely bad environment, let alone its application outdoors.

FIGS. 3, 3*a*, 3*b*, and 4 show an embodiment of the airtight RF coaxial connector of the present invention. Besides the exposed front end 4 of the plug outer conductor 3 of the airtight RF coaxial connector with self-locking by snap-fastening 1 as shown in FIGS. 1 and 2, a ring bulge 5 with right angle trapezoid shaped cross section is added to the connector. Meanwhile, the four-way longitudinal slits 3*a* of the RF coaxial connector 1 with self-locking by snap-fastening with no sealing are abolished as shown in FIGS. 1 and 2.

Furthermore, the longitudinal section of the ring bulge 5 is in the shape of right angle trapezoid, the hypotenuse of the trapezoid being faced with the front side of the socket connector, and the right angle side of the trapezoid being positioned normal to the longitudinal axis of the socket connector on the back side of the connector.

Furthermore, the inner hole of the socket connector 2 is cut to form a groove 6 that is provided with an O-shaped sealing ring 7.

The cross section of the groove 6 is generally in the shape of a trapezoid, its hypotenuse being faced with that of the longitudinal section of the ring bulge 5. However, the cross section of the groove 6 can be also other proper shapes helpful in preventing the sealing ring 7 from rolling.

The cross section of the sealing ring 7 can be in the shape of a circle, trapezoid, or any other proper shapes helpful in preventing itself from rolling.

The stiffness of the exposed part of the plug outer conductor 3 can be increased by means of abolishing the longitudinal slits at the front end of the plug outer conductor 3 of the plug connector 1, and providing at the front end of the plug outer conductor 3 a ring bulge 5 with right angle trapezoid shaped cross section. When the connector is in connection, the conical surface 5*a* of the ring bulge will automatically extrude the O-shaped sealing ring 7 positioned in the groove of the socket connector so as to realize the sealing effects of the connector.

When the plug connector 1 is connected with the socket connector 2, the conical surface 5*a* of the ring bulge 5 with right angle trapezoid shaped cross section will extrude the O-shaped sealing ring 7 inside the hole of the socket connector 2. By doing so, the sealing effects will be realized by preventing harmful substances, such as dust, mould, oxygen, sulfur dioxide, and water, from entering the connector 9 and oxygenizing or corroding the contact parts, and thus increasing the reliability of the connector.

In particular, connectors in accordance with the present invention can not only prolong its working life, but also be applied under relatively poor working environment outdoors.

In particular, the O-shaped sealing ring 7 can have shake-proof effects.

In fact, there can be other embodiments with the concept of the present invention. Those skilled in the art can easily modify, alter or improve the present invention according to the disclosure of this patent application. However, they will still in the scope of protection as claimed in the attached claims.

The invention claimed is:

1. An airtight RF coaxial connector with self-locking by snap-fastening, whose plug connector comprises a plug outer conductor, a locking cup connected with a socket connector, and an inner spring provided between the plug outer conductor and the locking cup, characterized in that the front end of the plug outer conductor is in the shape of continuous circles, forming an overall ring;

the front end of the plug outer conductor is provided with a ring-shaped bulge with right angle trapezoid shaped cross section, the hypotenuse of the trapezoid being faced with the front side of the socket connector, and the right angle side of the trapezoid being positioned normal to the longitudinal axis of the socket connector on the back side of the connector;

the inner part of the socket connector is provided with a groove provided with a sealing ring; and the distance between the mid-point of the ring bulge and the front contact surface of the plug outer conductor corresponds to that between the mid-point of the groove and the front contact surface of the socket connector.

2. The airtight RF coaxial connector with self-locking by snap-fastening according to claim 1, characterized in that the groove is with trapezoid shaped cross section, and the hypotenuse side of the trapezoid is positioned facing the hypotenuse of the longitudinal section of the ring bulge.

3. The airtight RF coaxial connector with self-locking by snap-fastening according to claim 1, characterized in that the sealing ring is with circle or trapezoid shaped cross section.

4. The airtight RF coaxial connector with self-locking by snap-fastening according to claim 1, characterized in that the distance between the mid-point of the ring bulge and the front contact surface of the plug outer conductor is the same as that between the mid-point of the groove and the front contact surface of the socket connector.

5. A plug connector of airtight RF coaxial connector with self-locking by snap-fastening comprises a plug outer conductor, a locking cup connected with the socket connector, and an inner spring provided between the plug outer conductor and the locking cup, characterized in that the front end of the plug outer conductor is in the shape continuous circles, forming an overall ring;

the front end of the plug outer conductor is provided with a ring bulge with longitudinal section in the shape of right angle trapezoid; the hypotenuse of the trapezoid is faced with the front side of the socket connector, being used to extrude the sealing ring positioned in the groove inside the socket connector; and the right angle side of the trapezoid is normal to the longitudinal axis of the socket connector on the back side of the connector; and the distance between the mid-point of the ring bulge and the front contact surface of the plug outer conductor corresponds to that between the mid-point of the groove and the front contact surface of the socket connector.

6. The plug connector of airtight RF coaxial connector with self-locking by snap-fastening according to claim 5, characterized in that the distance between the mid-point of the ring bulge and the front contact surface of the plug outer conductor is the same as that between the mid-point of the groove and the front contact surface of the socket connector.

* * * * *